US006109080A

United States Patent [19]

Chen et al.

[11] Patent Number: 6,109,080

[45] Date of Patent: Aug. 29, 2000

[54] TRANSMISSION DEVICES FOR LOCKS WITH CHANGEABLE LOCK CORE ASSEMBLIES

[75] Inventors: Po-Yang Chen; Ming-Shyang Chiou, both of Chiayi; Sheen-Youl Gao, Yunlin Hsien; Kun-Feng Tsai, Chiayi, all of Taiwan

[73] Assignee: Tong Lung Metal Industry Co., Ltd., Chiayi, Taiwan

[21] Appl. No.: 08/843,990

[22] Filed: Apr. 17, 1997

[30] Foreign Application Priority Data

Apr. 23, 1996 [TW] Taiwan ..... 85205957
Apr. 25, 1996 [TW] Taiwan ..... 85206117

[51] Int. Cl.[7] ..... E05B 9/04

[52] U.S. Cl. ..... 70/371; 70/224; 70/215; 70/379 R

[58] Field of Search ..... 70/370, 371, 379 R, 70/379 A, 380, 372, 451, 224, 215

[56] References Cited

U.S. PATENT DOCUMENTS

| | | | |
|---|---|---|---|
| 464,853 | 12/1891 | Case et al. | 70/379 R |
| 1,564,463 | 12/1925 | Best | 70/379 R |
| 1,835,130 | 12/1931 | Wread | 70/370 |
| 2,042,025 | 5/1936 | Schlage | 70/379 R |
| 2,213,262 | 9/1940 | Segal | 70/379 R |
| 2,642,735 | 6/1953 | Quigley | 70/380 |
| 2,720,408 | 10/1955 | Krupicka | 292/150 |
| 3,286,773 | 11/1966 | Russell et al. | 70/451 |
| 3,404,549 | 10/1968 | Best | 70/370 |
| 3,413,829 | 12/1968 | Russell | 70/371 |
| 5,233,851 | 8/1993 | Florian | 70/370 |
| 5,317,889 | 6/1994 | Solovieff et al. | 70/371 |
| 5,398,531 | 3/1995 | Shen | 70/371 |
| 5,752,399 | 5/1998 | Shen | 70/371 |

OTHER PUBLICATIONS

Locksmith Ledger, Oct. 1988 pp. 64,66,67.

*Primary Examiner*—Darnell M. Boucher
*Attorney, Agent, or Firm*—Bacon & Thomas, PLLC

[57] ABSTRACT

A lock assembly includes a handle assembly including a tubular member having an axial hole defined in a first end thereof and extending along a longitudinal axis thereof and a receptacle defined in a second end thereof and in communication with the axial hole, and a handle formed on the second end of the tubular member. A lock core assembly is removably mounted to the receptacle of the handle assembly and includes a lock core therein. The lock core includes a key hole defined in a first end thereof. A transmission device is received in the axial hole of the tubular member and includes a first end and a second end. The second end of the transmission device includes an end face plate extending in a direction transverse to a longitudinal axis of the key driving means, and two spaced positioning rods project outwardly from the end face plate and extend away from the first end along a direction parallel to the longitudinal axis of the transmission device. The lock core includes two positioning holes defined in a second end thereof and extending along a direction parallel to a longitudinal axis thereof. The positioning rods are removably extended through the holes in the second end of the lock core. The holes are respectively aligned with the positioning rods when mounting the lock core assembly into the receptacle.

2 Claims, 17 Drawing Sheets

TRANSMISSION DEVICES FOR LOCKS WITH CHANGEABLE LOCK CORE ASSEMBLIES

BACKGROUND OF THE INVENTION

1. Field of the Invention

The present invention relates to transmission devices for locks with changeable lock core assemblies and, more particularly, to transmission devices for locks with changeable lock core assemblies which allow easy, smooth operation during change of the lock core assemblies and which are simple in structures, easy in installation, and low in cost.

2. Description of the Related Art

Generally, locks include different types of structures responsive to different needs and different users, e.g., lever locks, trumpet locks, auxiliary locks, etc., wherein the lever locks and the trumpet locks are primary locks while the auxiliary locks provide further security in addition to the lever locks and the trumpet locks.

The lock core assemblies of traditional locks cannot be dismantled. FIGS. 1 and 2 of the drawings illustrate a conventional lever lock in which rotation of either handle "A" causes rotation of a wing-like driving member "C" of a tubular member "B", which, in turn, causes retraction or protruding movement of a latch bolt via transmission of an actuating member "D", thereby locking or unlocking the door to which the lever lock is mounted. The lock core assembly of the lever lock cannot be dismantled. Trumpet locks include similar structures and, therefore, the lock core assemblies thereof are also undetachable.

For safety consideration, house renters and hotel managers often change the locks after the previous tenants and guests have returned the keys, thereby improving security and preventing burglary and theft invents. Yet replacement of the whole lock is time-consuming. In addition, frequent replacements result in a decrease in the life-periods of the locks.

FIG. 3 of the drawing illustrates a conventional auxiliary lock which is commonly used in important departments of public places. However, same problems exist, especially in the case of transfer or resignation of the staff or there is a change in the employees in which all of the locks in the working area must be changed periodically, thereby avoiding loss of property due to unauthorized copying of the keys.

In view of the above-mentioned problems, locks having changeable lock core assemblies have been developed to meet the needs of different users, in which a lock core assembly can be removed from or inserted into the lock via a front side of the lock without detachment of any other elements of the lock. Generally, a lock with a changeable lock core assembly requires two keys, one of which can be operated to open or close the door to which the lock is mounted, while the other one of which is specifically used for change of the lock core assembly. However, it is found that a positioning protrusion of a transmission device of the lock cannot be effectively positioned after removal of the lock core assembly. More specifically, the positioning protrusion cannot be aligned with a hole of the lock core assembly during installation as the former is deviated by an angle or inclined, or due to rotation of either handle. Therefore, manufactures often annex a pushing rod to the packaged lock for users such that the user may use the pushing rod to push the positioning protrusion to a position in alignment with the hole of the lock core assembly for installation of the later. Nevertheless, it is still inconvenient for users.

Therefore, there has been a long and unfulfilled need for an improved lock with a changeable lock core assembly which mitigates and/or obviates the above-mentioned problems.

SUMMARY OF THE INVENTION

It is an object of the present invention to provide a transmission device for a lock with a changeable lock core assembly in which replacement of the lock core assembly of, e.g., a lever lock or trumpet lock, can be easily, smoothly accomplished.

It is another object of the present invention to provide a transmission device for an auxiliary lock such that the auxiliary lock may include a changeable lock core.

In accordance with one aspect of the invention, a transmission device is provided for a lock assembly which comprises a handle assembly including:

a tubular member having a first end, a second end, and a longitudinal axis, the first end of the tubular member including an axial hole defined therein and extending along the longitudinal axis of the tubular member, the second end of the tubular member including a receptacle defined therein and in communication with the axial hole, a handle being formed on the second end of the tubular member, a lock core assembly being removably mounted in the receptacle of the handle assembly and including a lock core therein, the lock core including a first end, a second end, and a longitudinal axis, the first end of the lock core having a key hole defined therein; and means for releasably retaining the lock core assembly in the receptacle upon rotation of the lock core assembly.

The transmission device comprises:

a key driving means received in the axial hole of the tubular member and including a first end and a second end, the second end of the key driving means including an end face plate extending in a direction transverse to a longitudinal axis of the key driving means, two spaced positioning rods projecting outwardly from the end face plate and extending away from the first end along a direction parallel to the longitudinal axis of the key driving means; and the second end of the lock core having two positioning holes defined therein and extending along a direction parallel to the longitudinal axis of the lock core, the positioning rods being removably extended through the holes in the second end of the lock core, wherein the holes are respectively aligned with the positioning rods when mounting the lock core assembly into the receptacle. (FIG. 4)

In accordance with a further aspect of the invention, a transmission device is provided for a lock assembly which comprises a handle assembly including:

a tubular member including therein a transverse plate which extends in a direction transverse to a longitudinal axis of the tubular member, the transverse plate being movable between a first position which is partially extended beyond the tubular member and a second position which is retracted into the tubular member;

a handle including a first end, a second end, and a longitudinal axis, the first end of the handle including an axial hole defined therein and extending along the longitudinal axis of the handle for partially receiving the tubular member, the second end of the handle including a receptacle defined therein and in communication with the axial hole, the handle further including a peripheral wall having a positioning slot defined therein through which the transverse plate is partially extended to the first position thereof, thereby engaging the handle with the tubular member, a lock core assembly being removably mounted to the receptacle of the handle assembly and including a lock core therein, the lock core including a first end, a second end, and a longitudinal axis, the first end of the lock core having a key hole defined therein; and means for releasably retaining the lock core assembly in the receptacle upon rotation of the lock core assembly.

The transmission device comprises:

a key driving means including a key driving tubular member and a transmission member, the key driving tubular member including a first end, a second end, and a longitudinal axis, the transmission member including a first end removably attached to the second end of the key driving tubular member and a second end, two spaced positioning rods projecting outwardly from the second end of the transmission member; and the second end of the lock core having two positioning holes defined therein and extending along a direction parallel to the longitudinal axis of the lock core, the positioning rods being removably extended through the holes in the second end of the lock core, wherein the holes are respectively aligned with the positioning rods when mounting the lock core assembly into the receptacle.

In one embodiment of the invention, the second end of the key driving tubular member includes a plate mounted therein and extending in a direction transverse to the longitudinal axis of the key driving tubular member. The plate includes an opening defined therein, and the transmission member includes a disc having a first side, a second side, and a longitudinal axis. An insert plate projects outwardly from the first side of the disc and extends along the longitudinal axis of the disc. The two spaced positioning rods project outwardly from the second side of the disc and extend along a direction parallel to the longitudinal axis of the disc. The insert plate is removably received in the opening of the plate in the key driving tubular member. (FIG. 5)

In another embodiment of the invention, the disc includes a central opening. The insert plate is releasably extended through the central opening to the second side of the disc, and the positioning rods project from an end of the insert plate located at the second side of the disc. The insert plate further includes a stop formed on a mediate section of each of two longitudinal sides thereof. (FIG. 14)

In a further embodiment of the invention, the disc further includes a second plate projecting outwardly from the second side thereof and extending along the longitudinal axis thereof. The transverse plate in the tubular member rests on a side of the second plate to prevent the transverse plate from being moved into the tubular member due to an external force, thereby preventing disengagement of the tubular member from the handle. When the transmission member is rotated through a pre-determined angle, the transverse plate is moved into the second position within the tubular member such that the tubular member is disengaged from the handle, thereby allowing removal of the handle. (FIG. 7)

In a still another embodiment, the disc includes a central opening, and the insert plate and the second plate are integral and releasably extended through the central opening and respectively located at the first side and the second side of the disc. The integral insert plate/second plate further includes a stop formed on a mediate section of each of two longitudinal sides thereof. (FIG. 13)

In a yet another embodiment of the invention, the disc further includes a second plate projecting outwardly from the second side thereof and extending along the longitudinal axis thereof, and the positioning rods project from the second plate located at the second side of the disc. (FIG. 15)

In a modified embodiment of the invention, the disc includes a cruciform central opening, and the insert plate and the second plate are integral and releasably extended through the central opening and respectively located at the first side and the second side of the disc. The integral insert plate/second plate further includes a stop formed on a mediate section of each of two longitudinal sides thereof. (FIG. 16)

In a still another embodiment of the invention, the second end of the key driving tubular member includes two diametrically extending grooves defined therein, the two grooves being perpendicular to each other. The disc includes two opposed lateral sides, and two engaging blocks are respectively formed on the two opposed lateral sides of the disc for releasably engaging one of the two diametrically extending grooves in the key driving tubular member. (FIG. 9; FIG. 11)

Preferably, the disc further includes at least one knurl projecting from a side thereof. The transverse plate in the tubular member rests on the knurl to prevent the transverse plate from being moved into the tubular member due to an external force, thereby preventing disengagement of the tubular member from the handle. When the transmission member is rotated through a pre-determined angle, the transverse plate is moved into the tubular member such that the tubular member is disengaged from the handle, thereby allowing removal of the handle.

In accordance with a further aspect of the invention, a transmission device for a lock assembly which comprises:

a sleeve including a first end and a second end, the sleeve further including a first hole and a second hole which is in communication with the first hole, the first and second holes together forming a receptacle for receiving a lock core assembly, a bore being defined in the second end of the sleeve and in communication with the second hole, a protrusion section being formed along a periphery defining the bore;

The transmission device connects the lock core assembly with the sleeve and comprises:

a positioning member including a plate which is attached to a bottom end wall defining the second hole and which has a central opening defined therein, the plate including two spaced positioning rods projecting from two opposed longitudinal sides thereof and extending away from the bottom end wall defining the second hole along a direction parallel to a longitudinal axis of a lock core of the lock core assembly received in the receptacle of the sleeve, the plate further including a protrusion which is formed on a lateral side thereof and which is received in the bore of the sleeve, the positioning rods being extended through two holes defined in the lock core of the lock core assembly and extending along a direction parallel to the longitudinal axis of the lock core;

a transmission element having a relatively large first end and a relatively small second end, the second end of the transmission element being extended through the central opening of the positioning member beyond the sleeve; and a rotational positioning element received in the second end of the sleeve, the rotational positioning element including an opening through which the second end of the transmission element extends, and a protrusion being formed around the opening and received in the bore of the sleeve.

The transmission element may include a stop knurl formed on a lateral side thereof adjacent to the first end thereof, and movements of the positioning member and the rotational positioning element are restrained between the first end of the transmission element and the stop knurl.

Other objects, advantages, and novel features of the invention will become more apparent from the following detailed description when taken in conjunction with the accompanying drawings.

DESCRIPTION OF THE PREFERRED EMBODIMENTS

Figure 1:
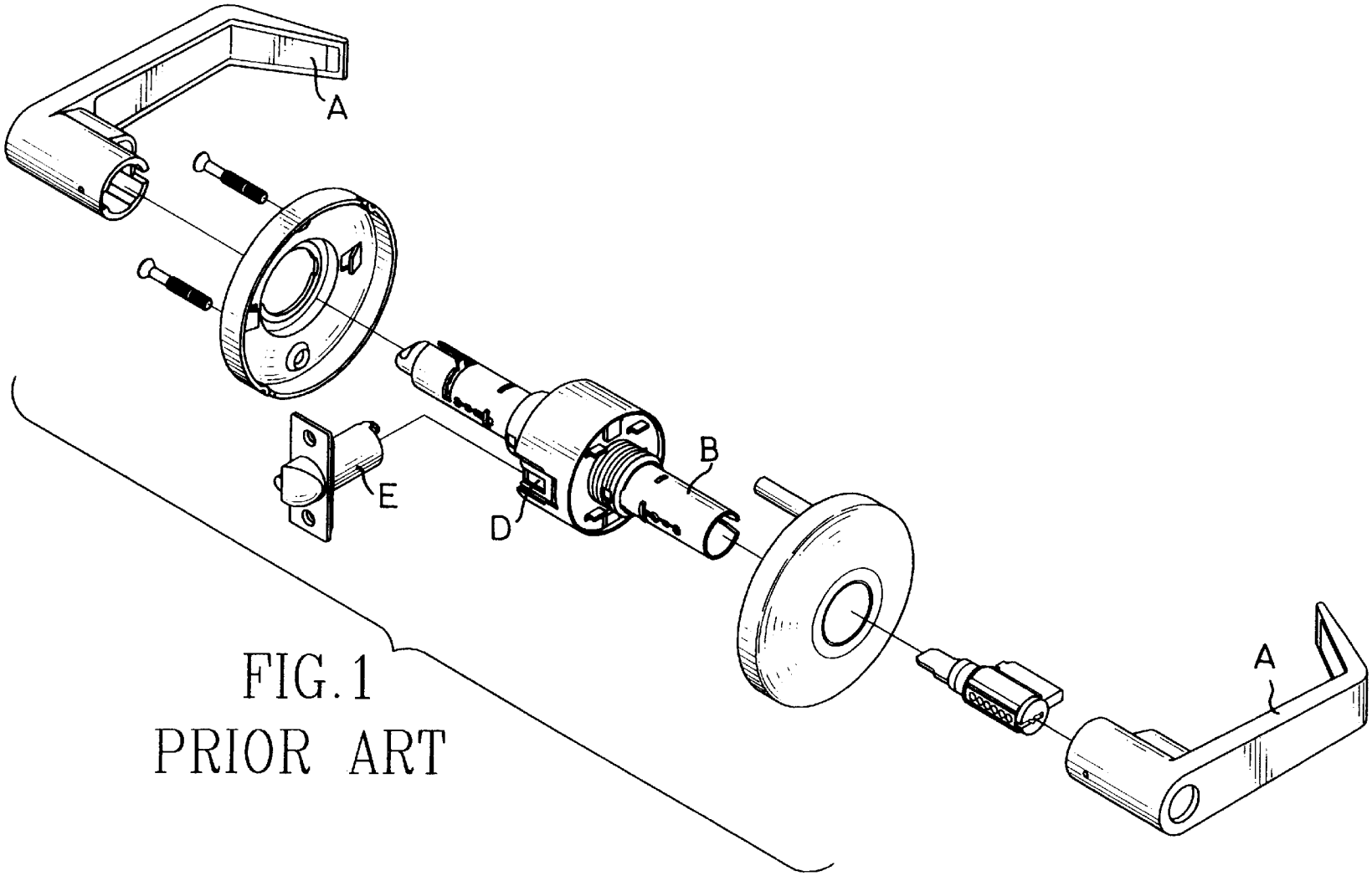
FIG. 1 PRIOR ART
FIG. 1 an exploded perspective view of a conventional lever lock.
Figure 2:
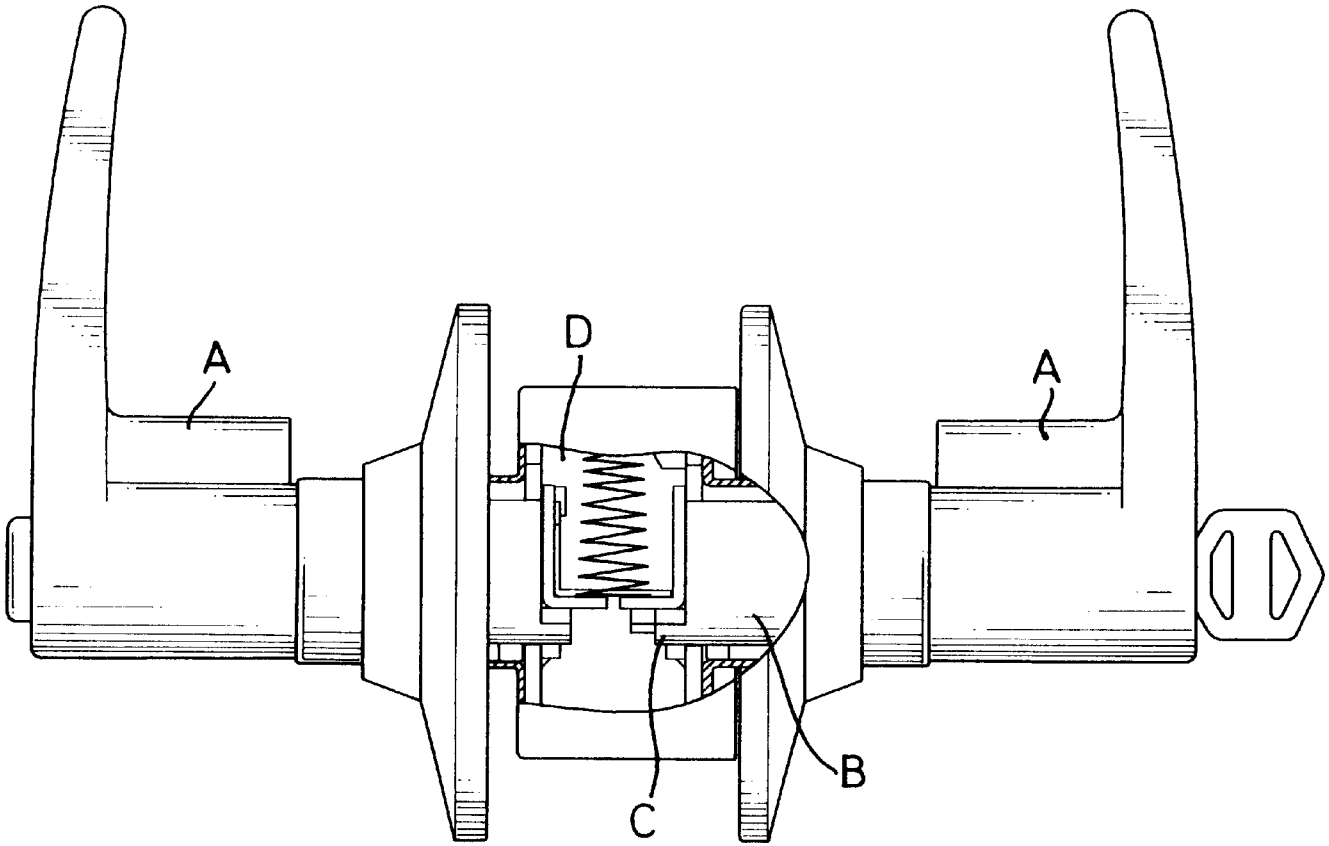
FIG. 2 PRIOR ART
FIG. 2 is a schematic side elevational view, partially sectioned, of the conventional lever lock in FIG. 1.
Figure 3:
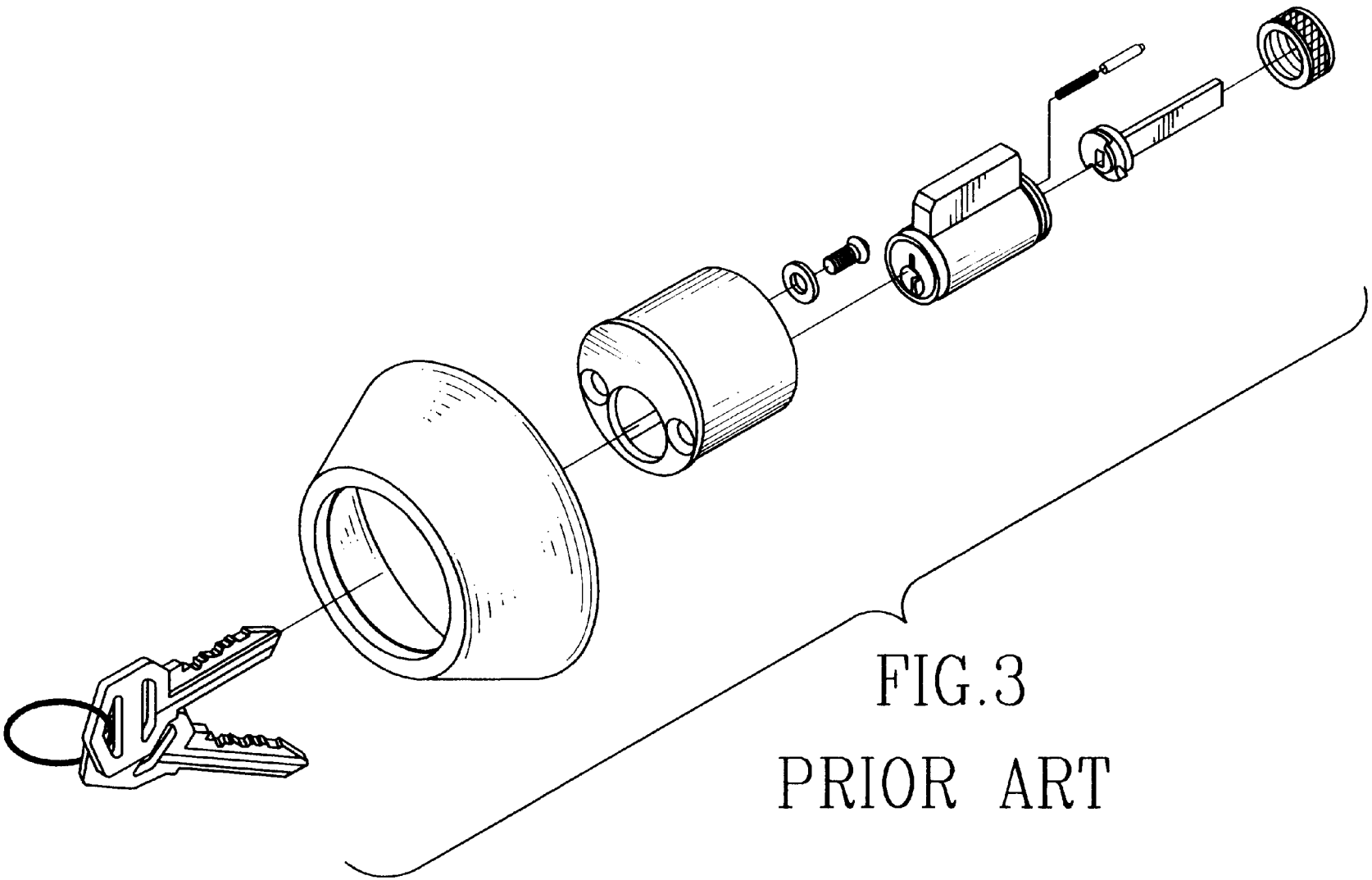
FIG.3 PRIOR ART
FIG. 3 is an exploded perspective view of a conventional auxiliary lock.
Figure 4:
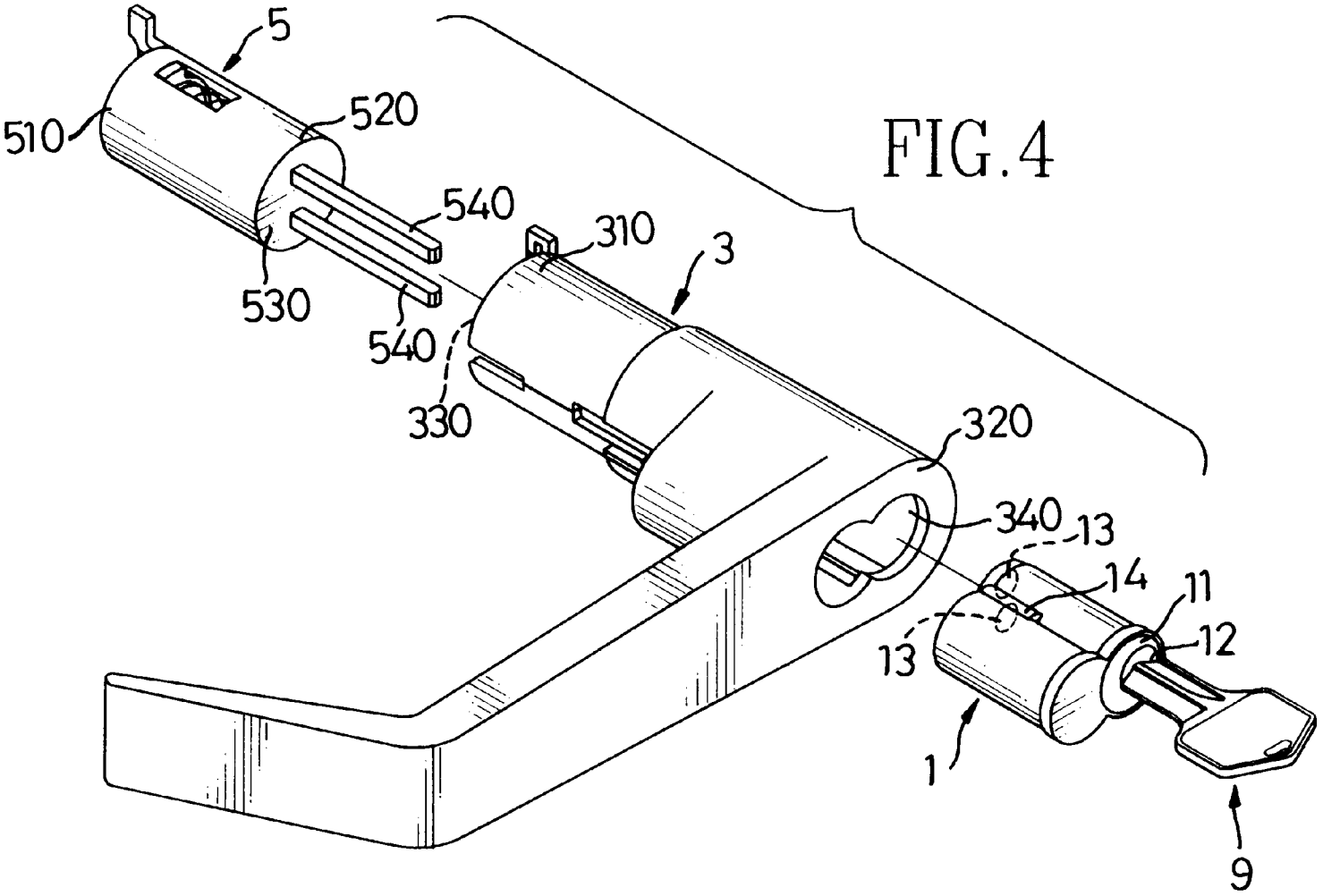
FIG. 4 is an exploded perspective view of a first embodiment of a transmission device in accordance with the present invention applied to a lever lock.

Referring to FIGS. 3 to 20 and initially to FIG. 4, in which an exploded perspective view of a first embodiment of a transmission device in accordance with the present invention applied to a lever lock is shown. It is appreciated that the transmission device can be applied to a trumpet lock in addition to the lever lock. As can be seen in FIG. 4, the lever lock includes a handle assembly 3 and a transmission device. The handle assembly 3 includes a tubular member having a first end 310 and a second end 320. The first end 310 includes an axial hole 330 defined therein and extending along a longitudinal axis of the tubular member, while the second end 320 includes a substantially "8" shaped receptacle 340 defined therein and in communication with the axial hole 330. The second end 320 further includes an engaging means (not shown) mounted therein and a lever-type handle (not labeled) extending therefrom. The first end 310 is connected to and thus actuates an actuating member (not shown) in the lever lock.

The transmission device includes a key driving means 5 which is cylindrical and includes a first end 510 and a second end 520. The second end 520 includes an end face plate 530 extending in a direction transverse to a longitudinal axis of the key driving means 5. Two spaced positioning rods 540 project outwardly from the end face plate 530 and extend away from the first end 510 along a direction parallel to the longitudinal axis of the key driving means 5.

A lock core assembly 1 is removably mounted in the "8" shaped receptacle 340 and includes a lock core 11 therein. The lock core 11 includes a key hole 12 to allow insertion of a key 9. The lock core 11 further includes two spaced holes 13 which are defined in an end opposite to the key hole 12 and which extend along a direction parallel to a longitudinal axis of the lock core assembly 1. The lock core assembly 1 further includes a protrusion 14 formed on an outer periphery thereof for positioning of the lock core assembly 1 in the receptacle 340.

In assembly, the key driving means 5 is received in the axial hole 330 of the handle assembly 3, wherein the positioning rods 540 of the key driving means 5 are extended into the "8" shaped receptacle 340. Then, the lock core assembly 1 is inserted into the "8" shaped receptacle 340 with the positioning holes 13 of the lock core assembly 1 in alignment with the positioning rods 540. Rotation of the key 9 for changing the lock core assembly 1 causes rotation of the whole lock core assembly 1 in a direction that the protrusion 14 may be engaged with an engaging means (not shown) of the handle assembly 3, thereby achieving positioning of the lock core assembly 1 in the "8" shaped receptacle 340. For normal locking and unlocking operation of the lever lock, a different key therefor (not shown) may be inserted into the key hole 12 to rotate the lock core 11, which, in turn, actuates the actuating member (not shown) via transmission of the key driving means 5, thereby locking or unlocking the lever lock. When changing the lock core assembly 1 is required, the key 9 is inserted and rotated through a pre-determined angle in an opposite direction to disengage the protrusion 14 from the engaging means (not shown) of the handle assembly 3, and the lock core assembly 1 is then removable from the "8" shaped receptacle 340, which is conventional and therefore not further described.

Figure 5:
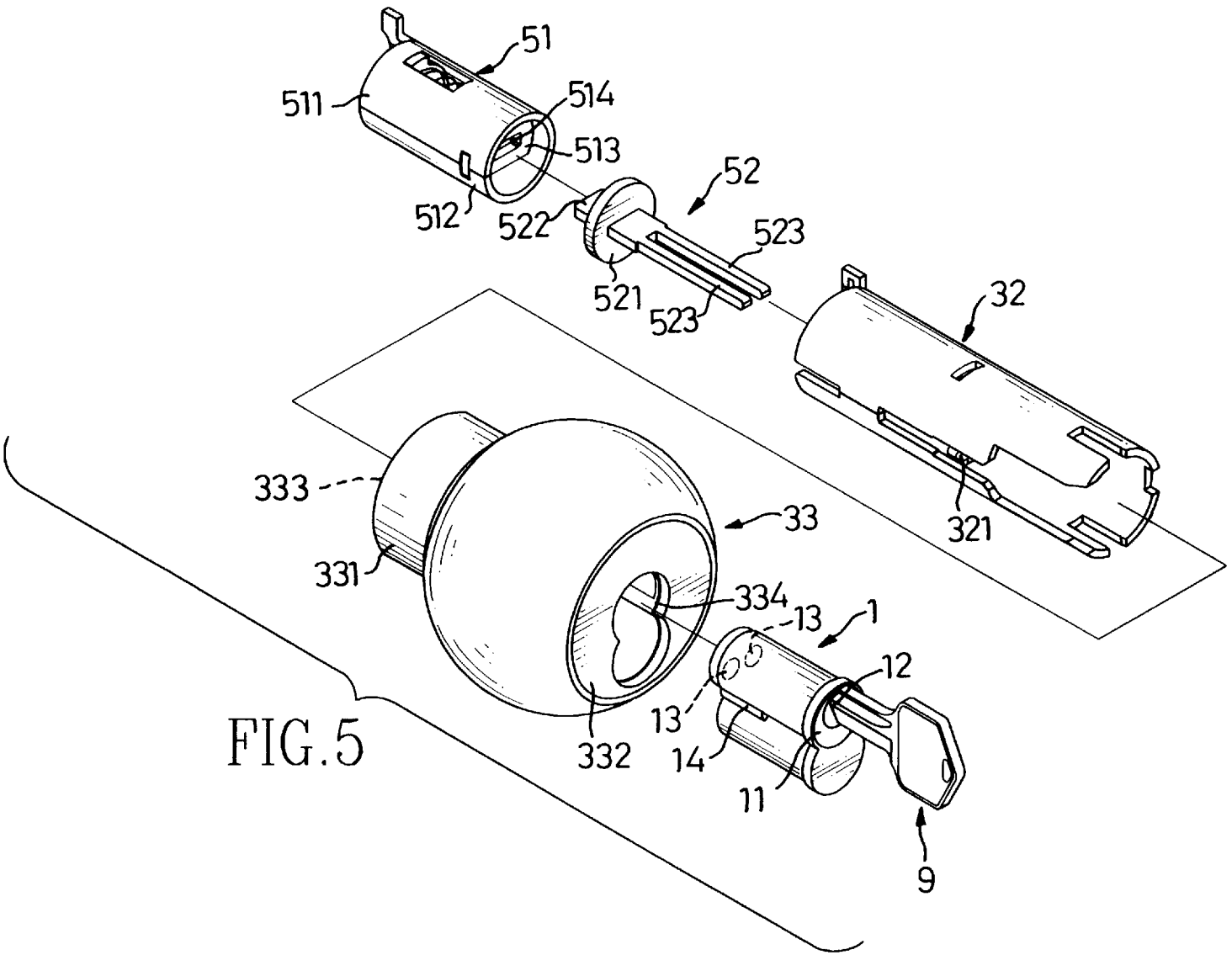
FIG. 5 is an exploded perspective view of a second embodiment of a transmission device in accordance with the present invention applied to a trumpet lock.
Figure 6:
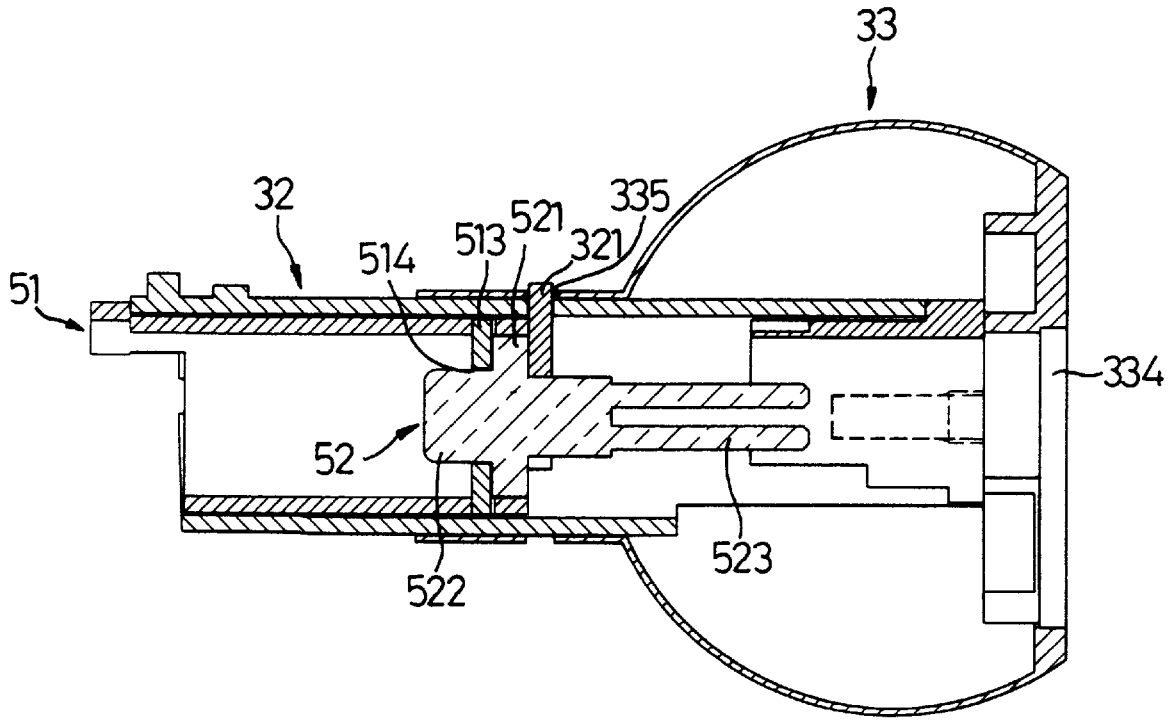
FIG. 6 is a cross-sectional view of the trumpet lock in FIG. 5.

The first embodiment can be modified so as to be applied to a trumpet lock. FIGS. 5 and 6 illustrate a second embodiment of the present invention, in which the trumpet lock includes a handle assembly and a transmission device. The handle assembly comprises a tubular member 32 and a knob-type handle 33. The transmission device includes a key driving means which, in turn, includes a key driving tubular member 51 and a transmission member 52.

The tubular member 32 includes therein a transverse plate 321 which extends in a direction transverse to a longitudinal axis of the tubular member 32 and which is located between two ends of the tubular member 32. The transverse plate 321 may be partially extended beyond a wall of the tubular member 32 or retracted into the tubular member 32. An elastic member (not shown) is provided to bias the transverse plate 321 to make the transverse plate 321 partially extend beyond the wall of the tubular member 32.

The handle 33 includes a first end 331 and a second end 332. The first end 331 includes an axial hole 333 defined therein and extending along a longitudinal axis of the handle 33 for receiving an end of the tubular member 32, while the second end 332 includes a substantially "8" shaped receptacle 334 defined therein and in communication with the axial hole 333. The second end 332 further includes an engaging means (not shown) mounted therein. As shown in FIG. 6, the handle 33 includes a peripheral wall having a positioning slot 335 defined therein. The above-mentioned transverse plate 321 may be partially extended through the positioning slot 335, thereby engaging the handle 33 with the tubular member 32 together.

The key driving tubular member 51 is cylindrical and includes a first end 511 and a second end 512. The second end 512 includes a plate 513 mounted therein and extending in a direction transverse to a longitudinal axis of the key driving tubular member 51. The plate 513 includes an opening 514 defined therein.

The transmission member 52 includes a disc 521 having a first side and a second side. An insert plate 522 projects outwardly from the first side and extends along a longitudinal axis of the disc 521. Two spaced positioning rods 523 project outwardly from the second side and extend along a direction parallel to the longitudinal axis of the disc 521. Preferably, the insert plate 522 and the positioning rods 523 extend on the same plane. The insert plate 522 is removably received in the opening 514 of the plate 513 in the key driving tubular member 51. As shown in FIG. 6, the transverse plate 321 in the tubular member 32 rests on a side of one of the positioning rods 523, thereby preventing the transverse plate 321 from being moved into the tubular member 32 due to an external force which may cause disengagement of the tubular member 32 from the handle 33. Yet, if the transmission member 52 is rotated through a predetermined angle, the transverse plate 321 is moved into the tubular member 32 such that the tubular member 32 is disengaged from the handle 33, thereby allowing removal of the handle 33.

Assembly of the second embodiment is substantially the same as that of the first embodiment. It is appreciated that, as shown in FIG. 6, the transverse plate 321 of the tubular member 32 and the plate 513 in the key driving tubular member 51 may tightly, securely retain the disc 521 of the transmission member 52 in position in a manner that the longitudinal axes of the positioning rods 523 of the transmission member 52 are substantially parallel to the longitudinal axis of the tubular member 32, thereby allowing easy insertion of a lock core assembly 1 into the tubular member 32 by means of the positioning rods 523 respectively and smoothly received in two positioning holes 13 of a lock core 11 (see FIG. 5) of the lock core assembly 1.

Figure 7:
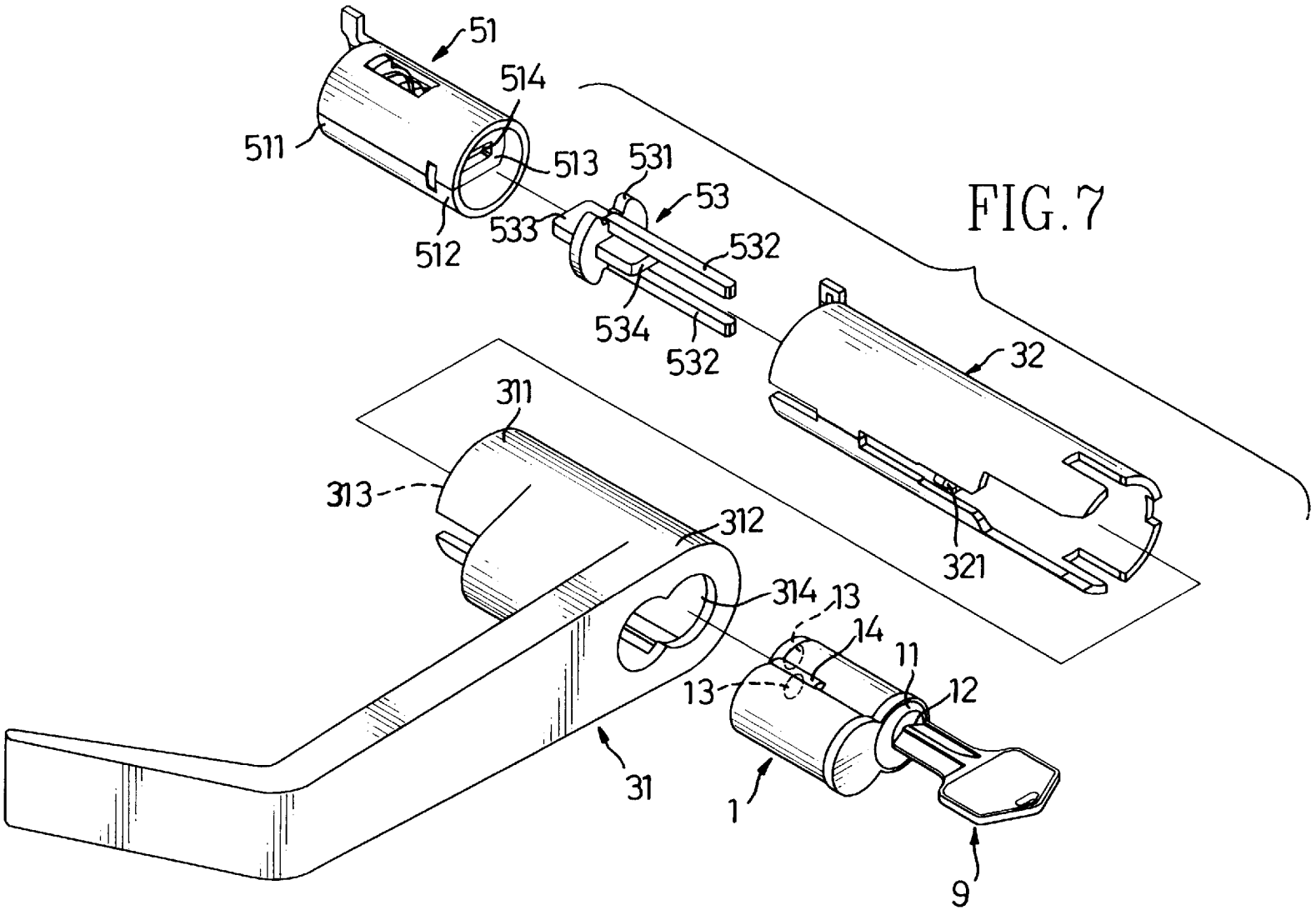
FIG. 7 an exploded perspective view of a third embodiment of a transmission device in accordance with the present invention applied to a lever lock.
Figure 8:
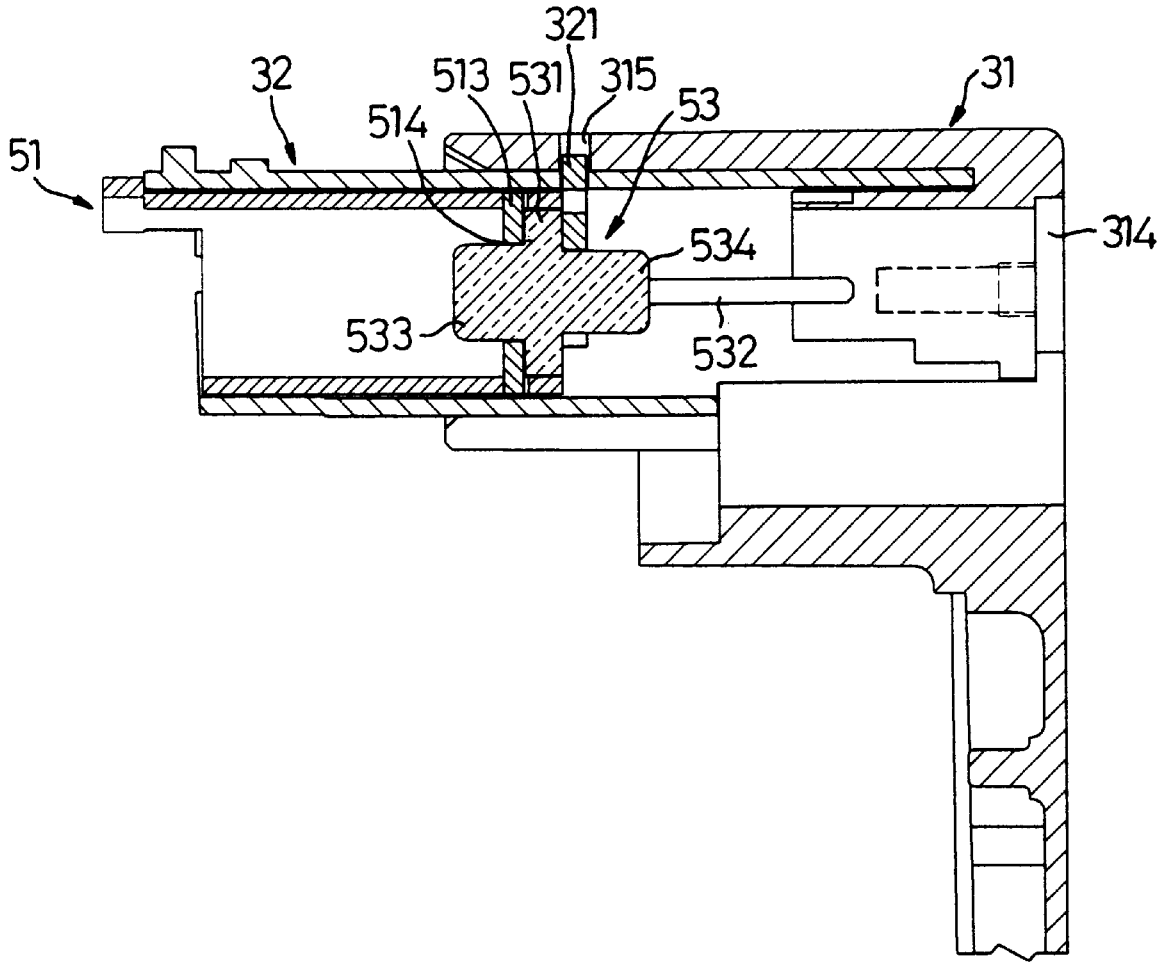
FIG. 8 a cross-sectional view of the lever lock in FIG. 7.

FIGS. 7 and 8 illustrate a third embodiment of the present invention, in which the substantially "8" shaped lock core assembly 1 for the lever lock illustrated therein is identical to the lock core assembly 1 for the trumpet lock in FIGS. 5 and 6, except for that there is a 90 degrees difference in installation angle. The key driving tubular member 51 and the tubular member 32 in this embodiment are identical to those disclosed in FIGS. 5 and 6 and therefore not further described. The knob-like handle 33 in FIGS. 5 and 6 is changed to a lever-like handle 31, and like elements thereof are designated by like reference numerals except by different leading numerals (i.e., "333" is changed to "313", "331" is changed to "311", etc.).

The transmission member 53 in this embodiment includes a disc 531 having a first side and a second side. An insert plate 533 projects outwardly from the first side and extends along a longitudinal axis of the disc 531. Two spaced positioning rods 532 project outwardly from the second side and extend along a direction parallel to the longitudinal axis of the disc 531. A second plate 534 projects outwardly from the second side and extends between the positioning rods 532 and along the longitudinal axis of the disc 531. Preferably, the insert plate 533 and the second plate 534 extend on the same plane, while the positioning rods 532 lie on a plane perpendicular to the insert plate 533. The insert plate 533 is removably received in the opening 514 of the plate 513 in the key driving tubular member 51. As shown in FIG. 8, the transverse plate 321 in the tubular member 32 rests on a side of the second plate 534, thereby preventing the transverse plate 321 from being moved into the tubular member 32 due to an external force which may cause disengagement of the tubular member 32 from the handle 31. Yet, if the transmission member 53 is rotated through a predetermined angle, the transverse plate 321 is moved into the tubular member 32 such that the tubular member 32 is disengaged from the handle 31, thereby allowing removal of the handle 31.

Assembly of the third embodiment is substantially the same as that of the second embodiment, the only difference therebetween is that the knob-like handle 33 is changed to the lever-like handle 31, wherein a longitudinal plane of the "8" shaped receptacle 334 of the knob-like handle 33 is perpendicular to that of the "8" shaped receptacle 314 of the lever-like handle 31 such that the installation degree therefor is rotated through 90 degrees. Nevertheless, for the whole transmission device, it is only required to modify the transmission member 52 to the transmission member 53 which has been hereinbefore described.

Figure 9:
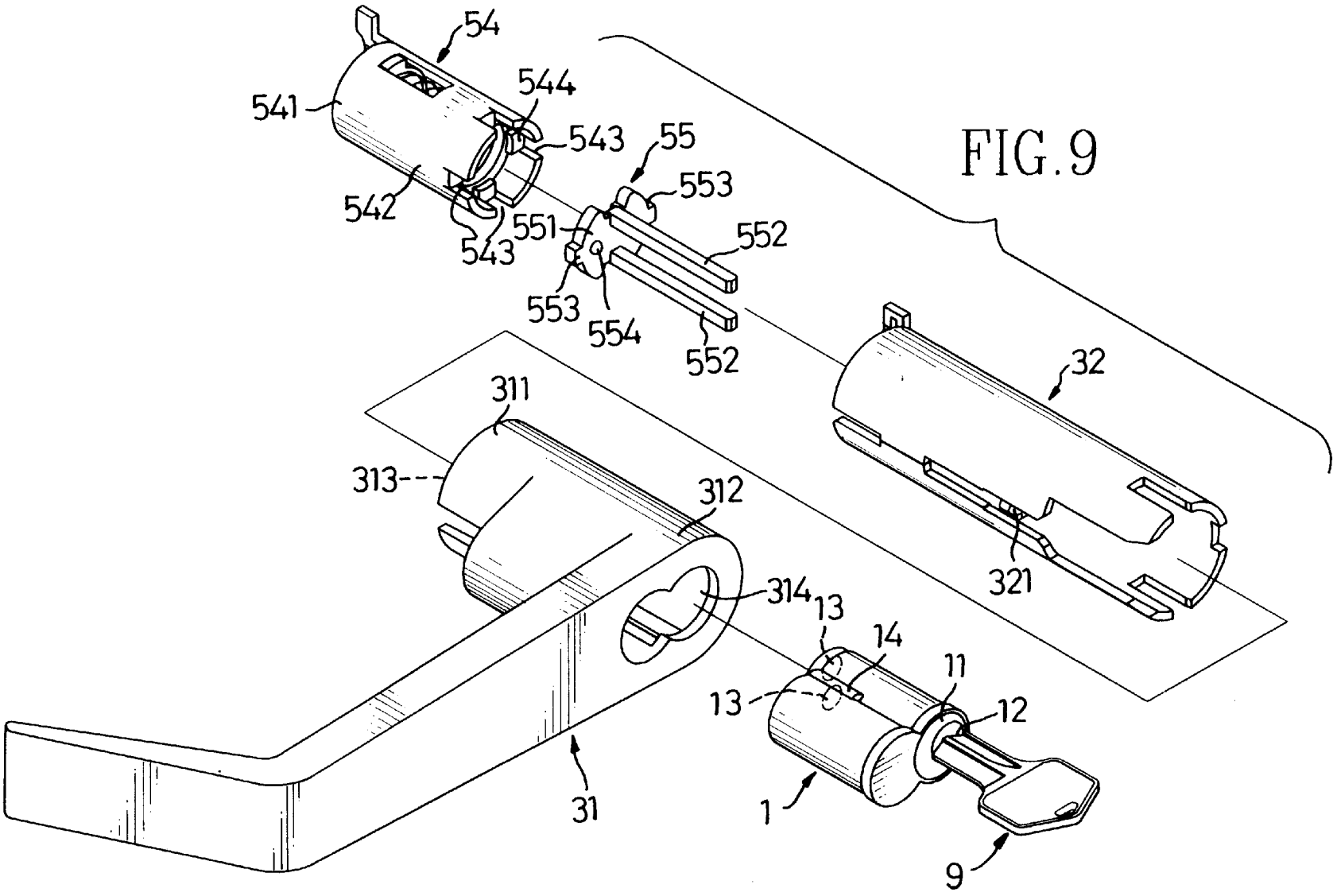
FIG. 9 an exploded perspective view of a fourth embodiment of a transmission device in accordance with the present invention applied to a lever lock.
Figure 10:
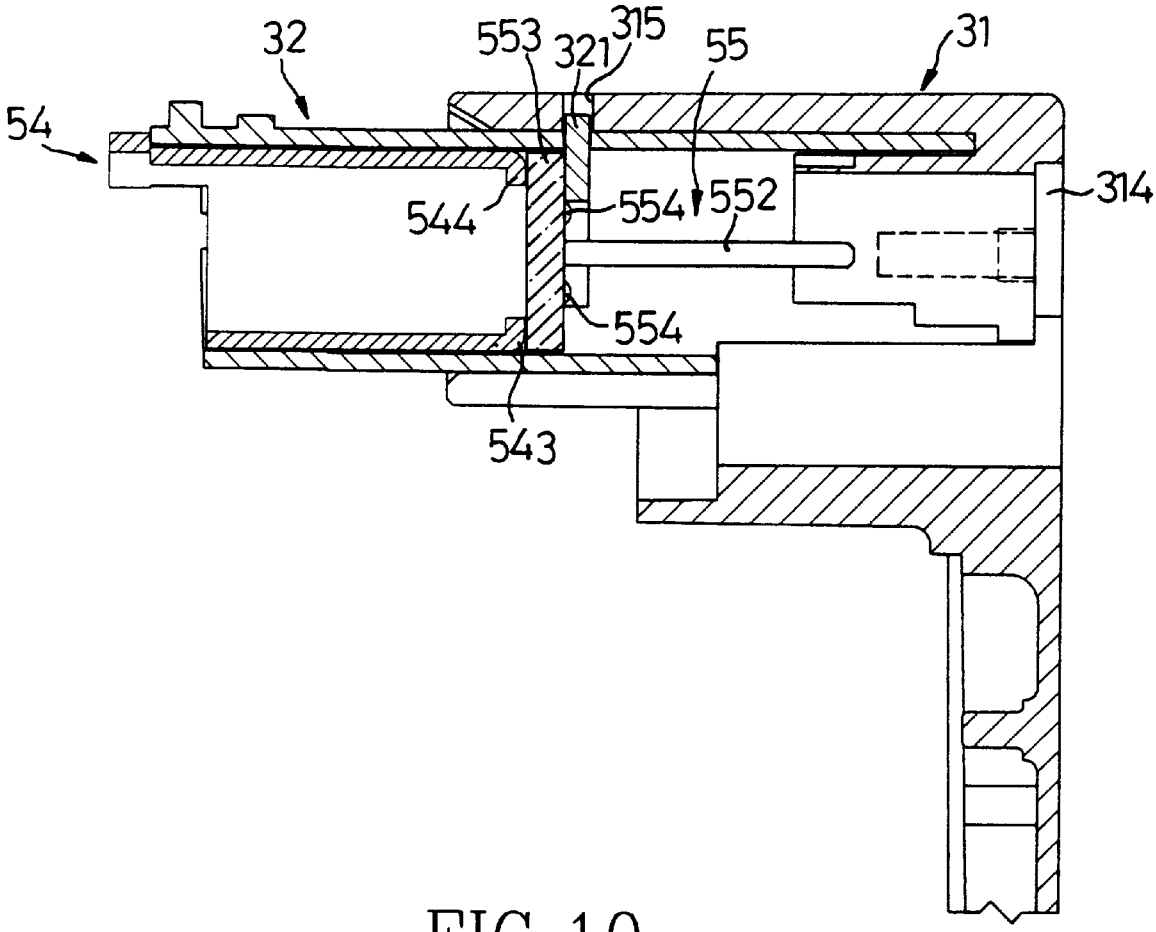
FIG. 10 a cross-sectional view of the lever lock in FIG. 9.
Figure 11:
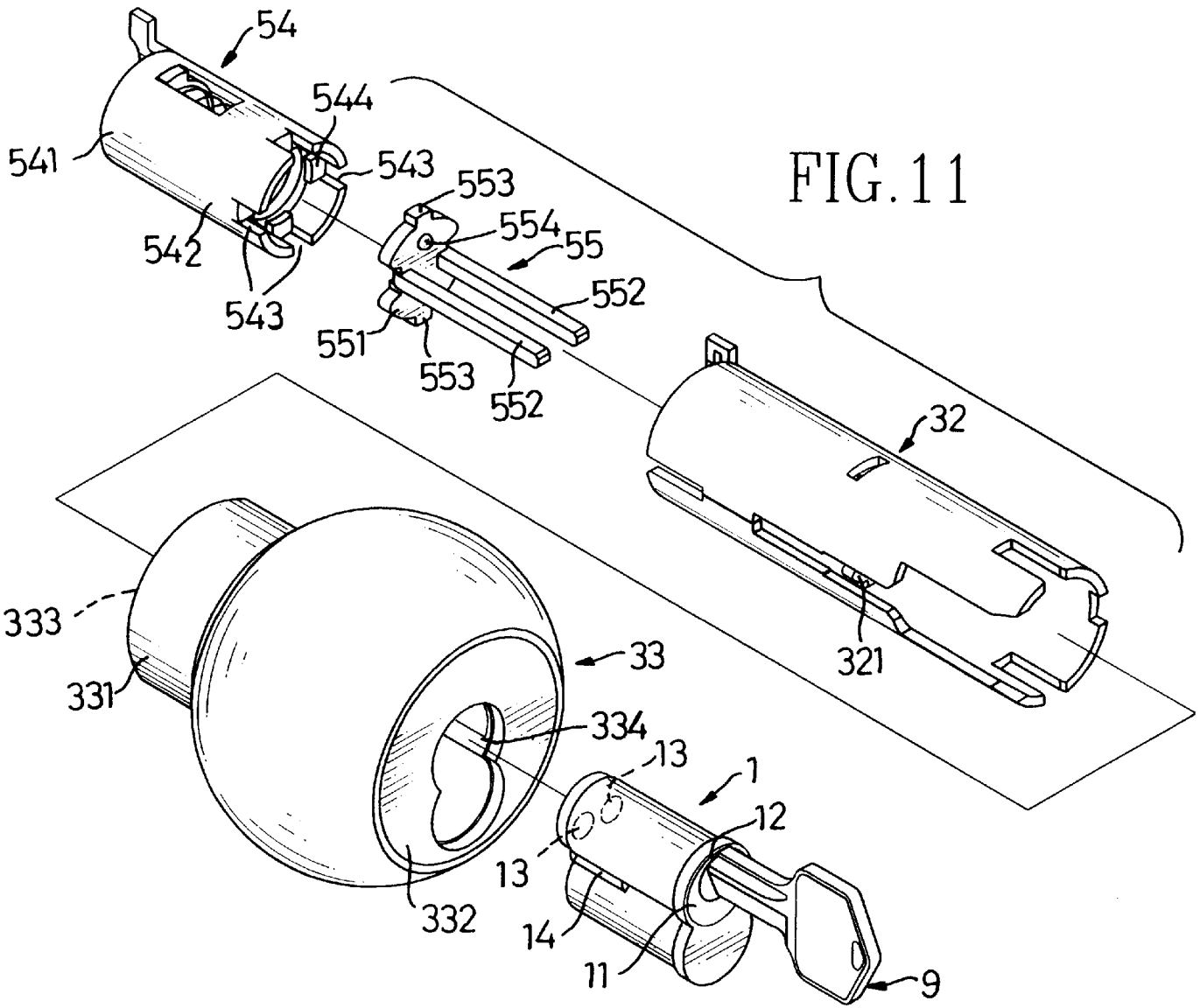
FIG. 11 is an exploded perspective view of the fourth embodiment of a transmission device in accordance with the present invention applied to a trumpet lock.
Figure 12:
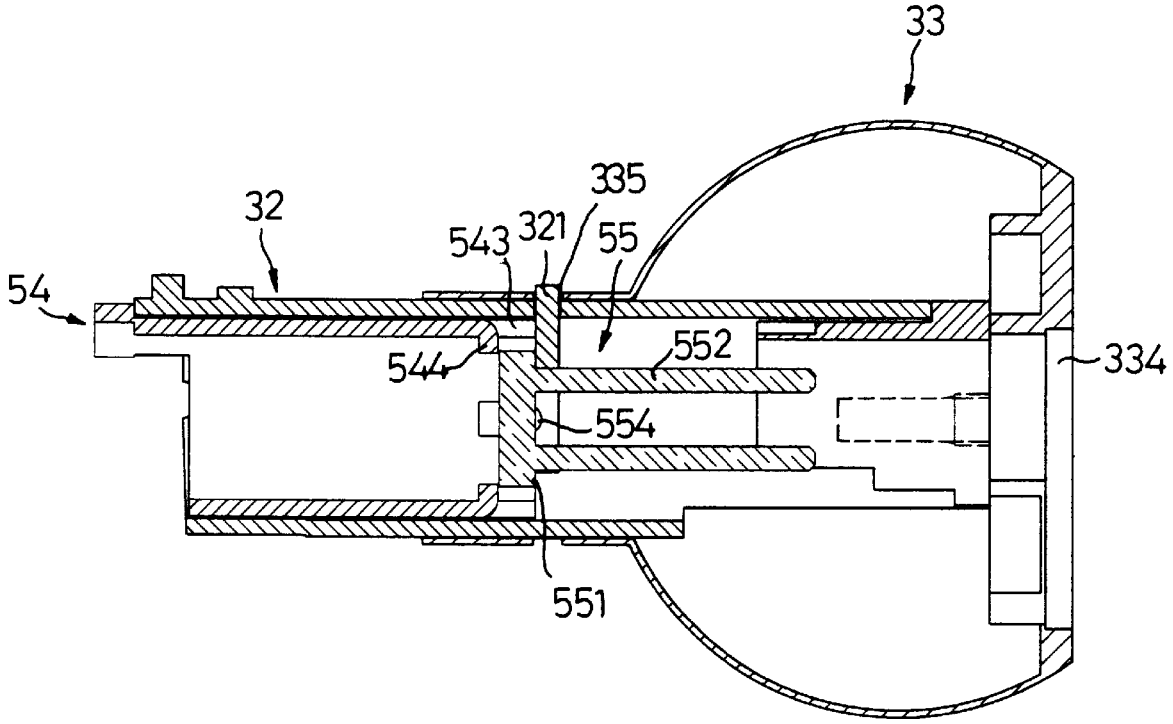
FIG. 12 is a cross-sectional view of the trumpet lock in FIG. 11.

FIGS. 9 to 12 illustrate a fourth embodiment of a transmission device in accordance with the present invention, in which the transmission device (i.e., the key driving means) may be applied to either a lever lock (FIGS. 9 and 10) or a trumpet lock (FIGS. 11 and 12)

In FIGS. 9 to 12, the transmission device (i.e., the key driving means) includes a key driving tubular member 54 and a transmission member 55. The key driving tubular member 54 includes a first end 541 and a second end 542. The second end 542 includes two diametrically extending grooves 543 defined therein. The two grooves 543 are perpendicular to each other. A block 544 is formed in an end of each of the grooves 543. The transmission member 55 includes a disc 551 having two spaced positioning rods 552 projecting from two opposed longitudinal sides thereof and extending away from the second end 542 of the key driving tubular member 54 along a longitudinal axis of the transmission member 55. Two engaging blocks 553 are respectively formed on two opposed lateral sides of the disc 551. The disc 551 further includes two knurls 554 projecting from a side thereof along a direction of which the positioning rods 552 extend.

When applied to a lever lock, as shown in FIGS. 9 and 10, the two engaging blocks 553 of the disc 551 are received in the horizontally extending groove 543 in FIG. 9. As shown in FIG. 10, the transverse plate 321 in the tubular member 32. rests on one of the knurls 554, thereby preventing the transverse plate 321 from being moved into the tubular member 32 due to an external force which may cause disengagement of the tubular member 32 from the handle 31. Yet, if the transmission member 55 is rotated through a pre-determined angle, the transverse plate 321 is moved into the tubular member 32 such that the tubular member 32 is disengaged from the handle 31, thereby allowing removal of the handle 31. Furthermore, each of the longitudinal sides of the disc 551 is indented in a mediate portion thereof (see FIG. 9), such that the disc 551 of the transmission member 55 can be securely held in a space defined between the blocks 544 of the key driving tubular member 54 and the transverse plate 321 of the tubular member 32, thereby assuring that the longitudinal axes of the positioning rods 552 are parallel to the longitudinal axis of the tubular member 32.

When applied to a trumpet lock, as shown in FIGS. 11 and 12, the two engaging blocks 553 of the disc 551 are received in the vertically extending groove 543 in FIG. 11 (by means of simply rotating the transmission member 55 in FIG. 9 through 90 degrees). As shown in FIG. 12, the transverse plate 321 in the tubular member 32 rests on a side of one of the positioning rods 552, thereby preventing the transverse plate 321 from being moved into the tubular member 32 due to an external force which may cause disengagement of the tubular member 32 from the handle 31. Yet, if the transmission member 55 is rotated through a pre-determined angle, the transverse plate 321 is moved into the tubular member 32 such that the tubular member 32 is disengaged from the handle 31, thereby allowing removal of the handle 31. Again, each of the longitudinal sides of the disc 551 is indented in a mediate portion thereof (see FIG. 11), such that the disc 551 of the transmission member 55 can be securely held in a space defined between the blocks 544 of the key driving tubular member 54 and the transverse plate 321 of the tubular member 32, thereby assuring that the longitudinal axes of the positioning rods 552 are parallel to the longitudinal axis of the tubular member 32.

Figure 13:
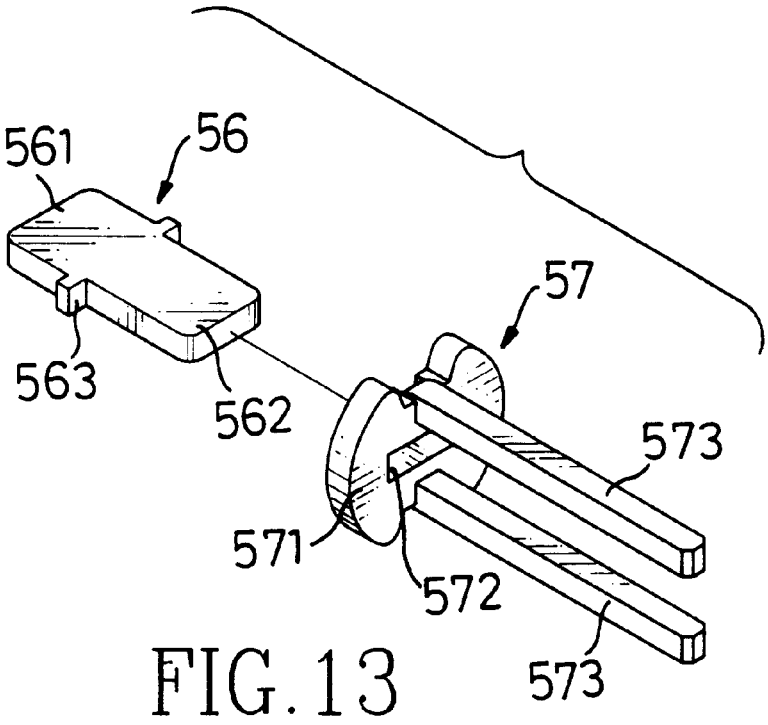
FIG. 13 is an exploded perspective view illustrating a modified embodiment of a transmission member of the third embodiment of the transmission device in accordance with the present invention.

FIG. 13 illustrates a modified embodiment of the transmission member of the third embodiment (cf. FIG. 7) of the transmission device, wherein the transmission member 53 (see FIG. 7) may comprise two parts: a connecting plate 56 and a transmission element 57. The connecting plate 56 is substantially rectangular and includes a first end 561 and a second end 562. A stop 563 is formed on a mediate section of each of two longitudinal sides of the connecting plate 56. The transmission element 57 includes a disc 571 having a central opening 572 defined therein through which the second end 562 of the connecting plate 56 extends. The disc 571 includes two spaced positioning rods 573 projecting from two opposed longitudinal sides thereof and extending away from the stops 563 of the connecting plate 56 along a direction parallel to a longitudinal axis of the disc 571. The second end 562 of the connecting plate 56 may be extended through the central opening 572 of the disc 571 until the stops 563 bear against a periphery defining the central opening 572 of the disc 571, thereby forming an integral unit.

Figure 14:
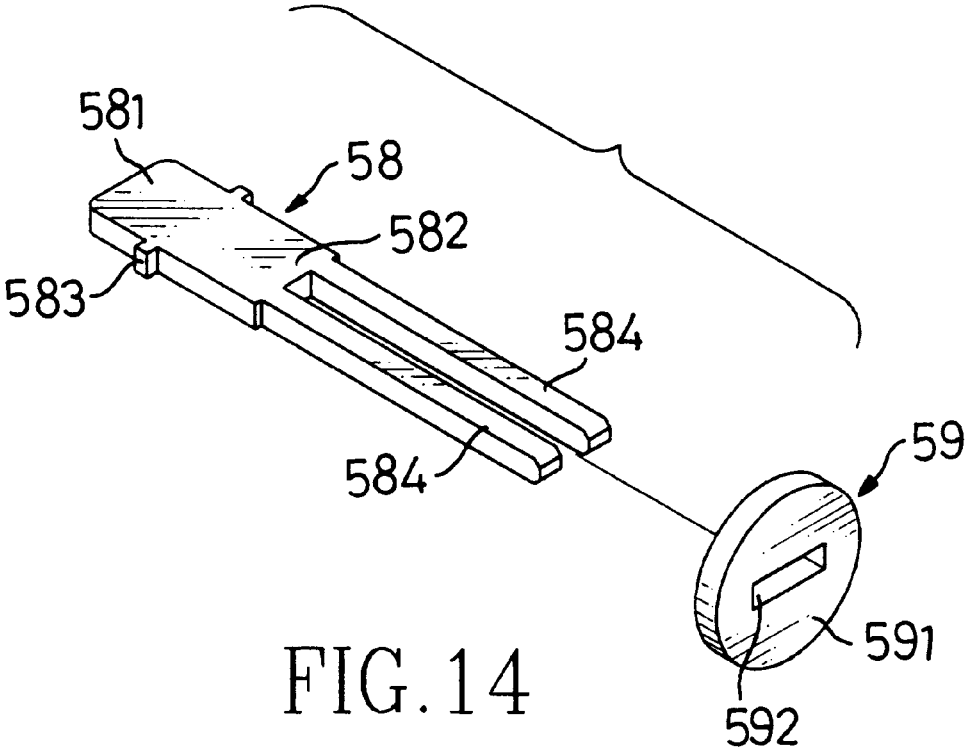
FIG. 14 is an exploded perspective view illustrating a modified embodiment of a transmission member of the second embodiment of the transmission device in accordance with the present invention.

FIG. 14 illustrates a modified embodiment of the transmission member of the second embodiment (cf. FIG. 5) of the transmission device, wherein the transmission member may comprise two parts: a positioning disc 59 and a transmission element 58. The positioning disc 59 is substantially a circular disc 591 with a central opening 592 defined therein. The transmission element 58 is substantially a rectangular plate which includes a first end 581 and a second end 582. A stop 583 is formed on a mediate section of each of two longitudinal sides of the transmission element 58. The transmission element 58 further includes two spaced positioning rods 584 projecting from the second end 582 thereof and extending away from the stops 583 along a direction parallel to a longitudinal axis of the transmission element 58. The second end 582 as well as the positioning rods 584 of the transmission element 58 may be extended through the central opening 592 of the disc 591 until the stops 583 bear against a periphery defining the central opening 592 of the disc 591, thereby forming an integral unit.

Figure 15:
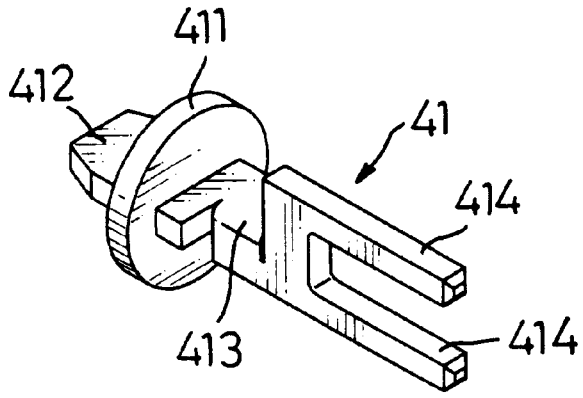
FIG. 15 is a perspective view of a transmission member of a fifth embodiment of the transmission device in accordance with the present invention.

FIG. 15 illustrates a fifth embodiment of the present invention which is modified from the transmission member 53 of the third embodiment. As can be seen in FIG. 15, the transmission member, which is now designated by reference numeral "41", includes a disc 411 having a first side and a second side. A first plate 412 projects outwardly from the first side and extends along a longitudinal axis of the disc 411. A second plate 413 projects outwardly from the second side and extends along the longitudinal axis of the disc 411. Two spaced positioning rods 414 project outwardly from the second plate 413 and extend along a direction parallel to the longitudinal axis of the disc 413. Assembly and operation of the fifth embodiment are the same as those of the third embodiment and are therefore not redundantly described.

Figure 16:
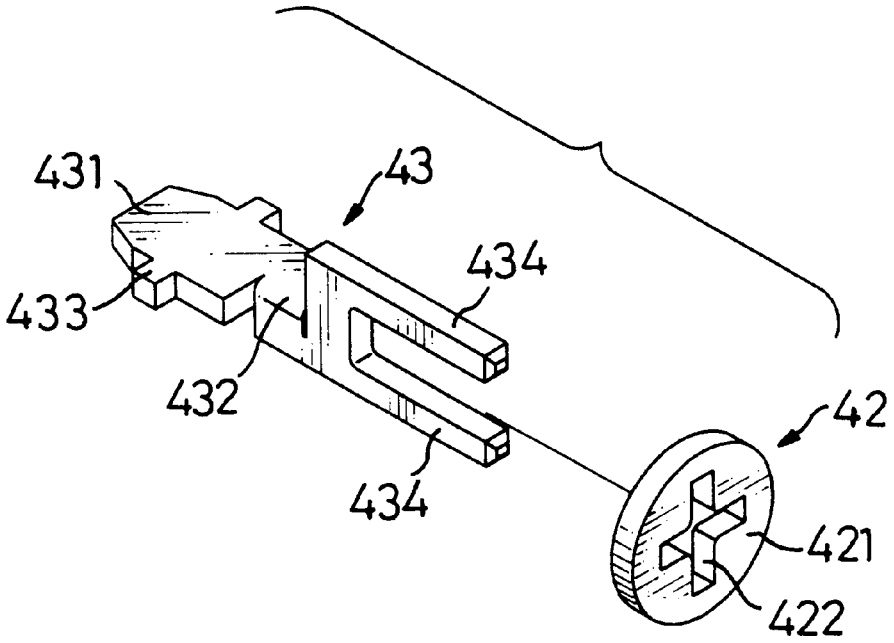
FIG. 16 an exploded perspective view illustrating a modified embodiment of the transmission rod in FIG. 15.

FIG. 16 illustrates a modified embodiment of the transmission member of the fifth embodiment (cf. FIG. 15) of the transmission device, wherein the transmission member comprises two parts: a positioning disc 42 and a transmission element 43. The positioning disc 42 is substantially a circular disc 421 with a central cruciform opening 422 defined therein. The transmission element 43 is substantially a rectangular plate which includes a first end 431 and a second end 432. A stop 433 is formed on a mediate section of each of two longitudinal sides of the transmission element 43. The transmission element 43 further includes two spaced positioning rods 434 projecting from the second end 432 thereof and extending away from the stops 433 along a direction parallel to a longitudinal axis of the transmission element 43. The second end 432 as well as the positioning rods 434 of the transmission element 43 may be extended through the central cruciform opening 422 of the disc 421 until the stops 433 bear against a periphery defining the central cruciform opening 422 of the disc 421, thereby forming an integral unit.

Figure 17:
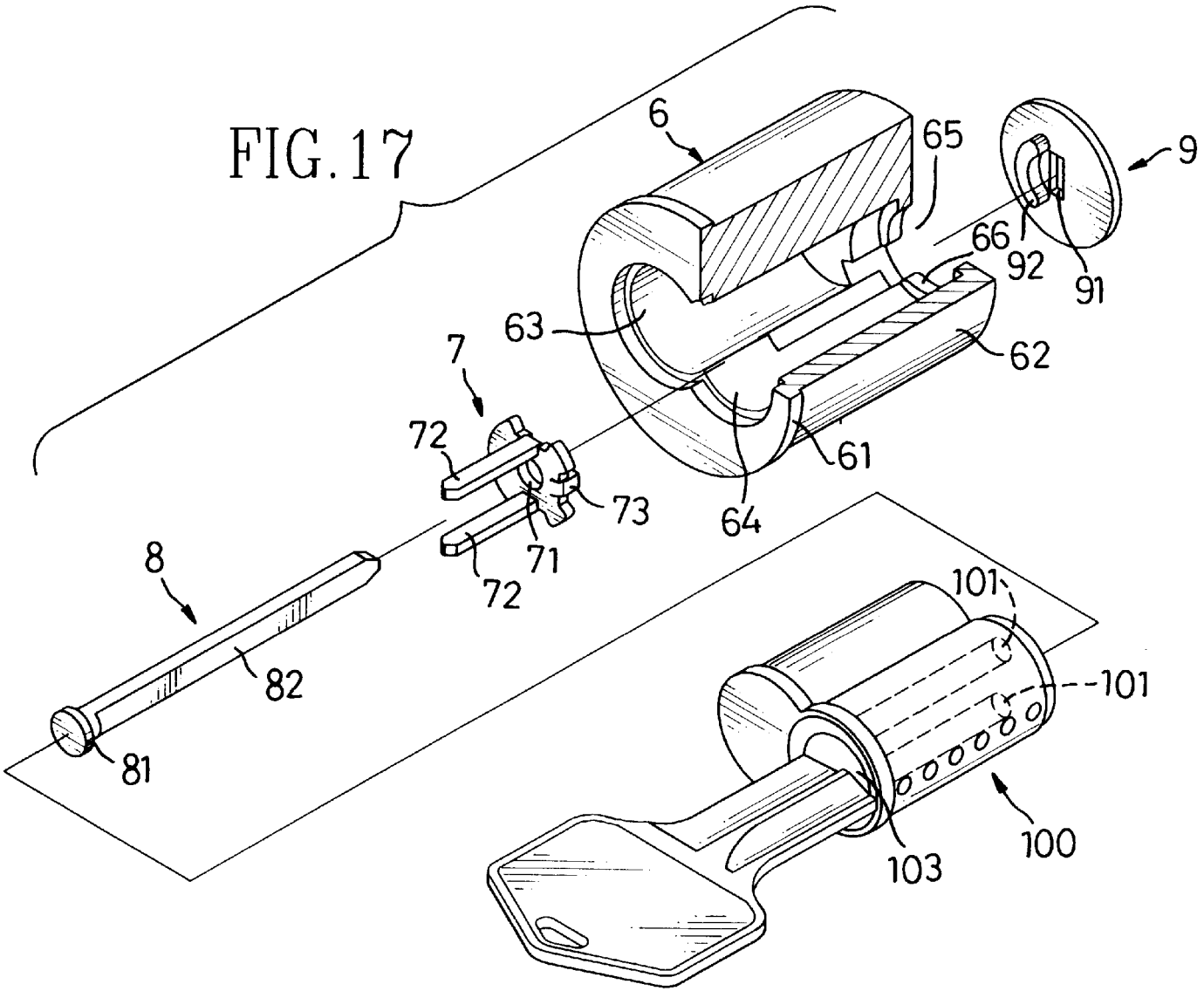
FIG. 17 is an exploded perspective view of a further embodiment of the transmission device in accordance with the present invention applied to an auxiliary lock.
Figure 19:
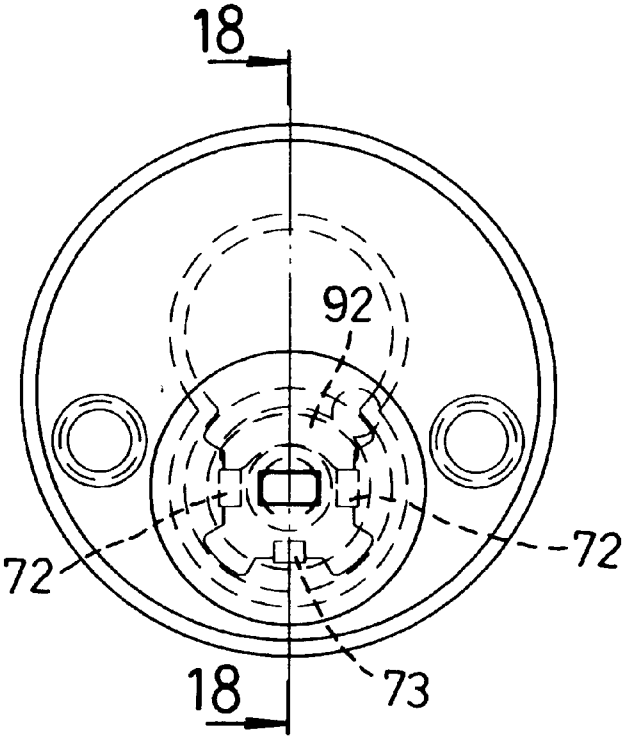
FIG. 19 is an end view of the auxiliary lock in FIG. 18.
Figure 18:
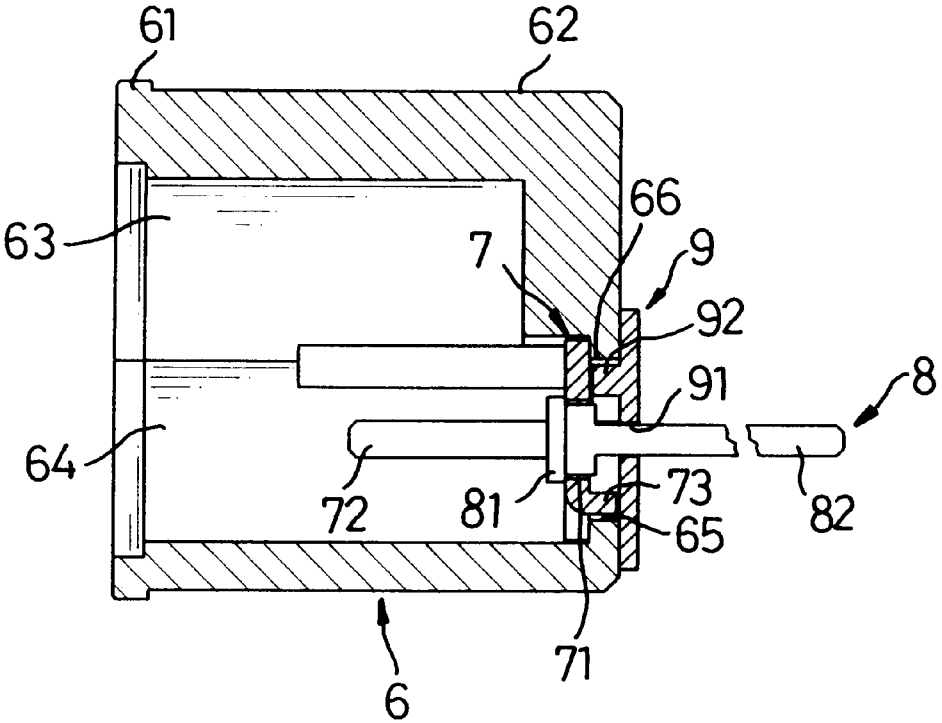
FIG. 18 is a cross-sectional view, taken along line 18—18 of FIG. 19, of the auxiliary lock in FIG. 17.

FIGS. 17 to 19 illustrate a further embodiment of the transmission device in accordance with the present invention which is applied to an auxiliary lock. The transmission device, which is used to connect a lock core assembly 100 (see FIG. 17) of an auxiliary lock with a sleeve 6 of the auxiliary lock, includes a positioning member 7, a transmission element 8, and a rotational positioning element 9.

The sleeve 6 is substantially cylindrical and includes a first end 61 and a second end 62. The sleeve 6 further includes a first hole 63 and a second hole 64 which is in communication with the first hole 63. The first and second holes 63 and 64 together form a substantially "8" shaped receptacle for receiving the lock core assembly 100. A bore 65 is defined in the second end 62 of the sleeve 6 and is in communication with the second hole 64, as shown in FIG. 18. A protrusion section 66 is formed along a periphery defining the bore 65.

The positioning member 7 is substantially a plate which is attached to a bottom end wall defining the second hole 64 and which has a central opening 71 defined therein. The plate includes two spaced positioning rods 72 projecting from two opposed longitudinal sides thereof and extending away from the bottom end wall defining the second hole 64 along a direction parallel to a longitudinal axis of a lock core 103 of the lock core assembly 100 received in the "8" shaped receptacle of the sleeve 6. The plate further includes a protrusion 73 which is formed on a lateral side thereof and which is received in the bore 65 of the sleeve 6. The positioning rods 72 may be extended through two holes 101 defined in the lock core 103 of the lock core assembly 100 and extending along a direction parallel to the longitudinal axis of the lock core 103.

The transmission element 8 is substantially a rod having a relatively large first end 81 and a relatively small second end 82. The second end 82 is extended through the central opening 71 of the positioning member 7 beyond the sleeve 6.

The rotational positioning element 9 is substantially a disc received in the second end 62 of the sleeve 6. The rotational positioning element 9 includes an opening 91 through which the second end 82 of the transmission element 8 extends. Nevertheless, it is appreciated that the rotational positioning element 9 and the transmission element 8 can be made together by fitting engagement, riveting, welding, gluing, etc. A protrusion 92 is formed around the opening 91 and can be received in the bore 65 of the sleeve 6. Alternatively, the protrusion 92 can be replaced by a plurality of aligned knurls.

In assembly, the second end 82 of the transmission element 8 is extended through the opening 71 of the positioning member 7, and the first end 81 of the transmission element 8 bears against the positioning member 7. Then, positioning member 7 and the transmission element 8 are inserted into the second hole 64 of the sleeve 6, in which the second end 82 of the transmission element 8 is extended beyond the second end 62 of the sleeve 6, while the protrusion 73 of the positioning member 7 is received in the bore 65 of the sleeve 6. The second end 82 of the transmission element 8 is fittingly extended through the opening 91 of the rotational positioning element 9, and the protrusion 92 of the rotational positioning element 9 is received in the bore 65 of the sleeve 6 and spaced from the protrusion 73 of the positioning member 7. Thereafter, for insertion of the lock core assembly 100, the holes 101 of the lock core 103 are aligned with the positioning rods 72 of the positioning member 7 and moved along a longitudinal axis of the lock core 103 until the lock core 103 is received in the receptacle of the sleeve 6 defined by the first and second holes 63 and 64 of the sleeve 6. When a key (not shown) for locking and unlocking is inserted into a key hole (not labeled) of the lock core 103 and rotated through a predetermined angle, the protrusion 73 of the positioning member 7 bears against the protrusion 92 of the rotational positioning element 9 to make the rotational positioning member 9 and the transmission element 8 rotate together, thereby causing a portion of the second end 82 of the transmission element 8 to engage with a latch bolt (not shown) to move therewith.

Figure 20:
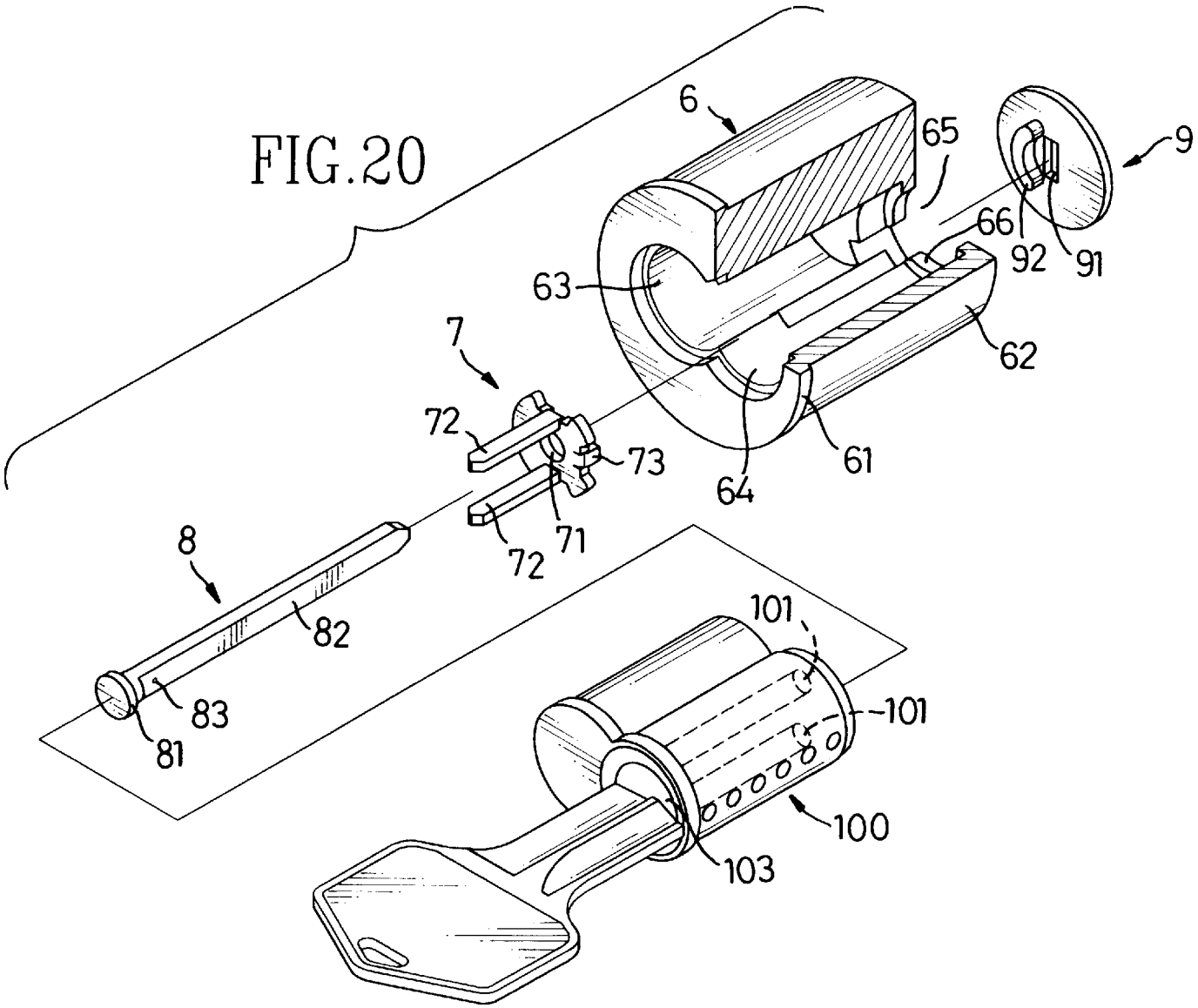
FIG. 20 is an exploded view of another embodiment of the transmission device in accordance with the present invention applied to an auxiliary lock.

FIG. 20 illustrates a modified embodiment of the transmission device in FIG. 17, in which a stop knurl 83 is formed on the transmission element 8 adjacent to the first end 81, such that the positioning member 7 and the rotational positioning element 9 are restrained between the first end 81 and the stop knurl 83.

Although the invention has been explained in relation to its preferred embodiment, it is to be understood that many other possible modifications and variations can be made without departing from the spirit and scope of the invention as hereinafter claimed.

What is claimed is:

1. A lock assembly, comprising:

a tubular member including a transverse plate mounted therein which extends in a direction transverse to a longitudinal axis of the tubular member, wherein the transverse plate is movable between a first position where the transverse plate is partially extended beyond the tubular member and a second position where the transverse plate is retracted into the tubular member;

a handle having a first end, a second end, and a longitudinal axis, the first end of the handle containing an axial hole defined therein and extending through the longitudinal axis of the handle for partially receiving and maintaining the tubular member, the second end of the handle containing a receptacle defined therein and connecting to the axial hole, the handle having a peripheral wall containing a positioning slot defined therein through which the transverse plate is partially extended to the first position thereof, thereby engaging the handle with the tubular member;

a lock core assembly removably mounted on the receptacle of the handle and including a lock core therein, the lock core including a first end, a second end, and a longitudinal axis, the first end of the lock core containing a key hole defined therein, the second end of the lock core containing two positioning holes defined therein each extending along a direction parallel to the longitudinal axis of the lock core;

means for releasably retaining the lock core assembly in the receptacle upon rotation of the lock core assembly;

a key driving tubular member having a first end, a second end, and a longitudinal axis, the second end of the key driving tubular member including a plate mounted therein and extending in a direction transverse to the longitudinal axis of the key driving tubular member, the plate containing an opening defined therein;

a transmission member having a first end, a mediate portion, and a second end, two parallel arranged positioning rods each extending outward from the second end of the transmission member, a disc mounted on the mediate portion of the transmission member and having a first side, a second side, and a longitudinal axis, each of the two positioning rods located adjacent to the second side of the disc, the disc including a second plate projecting outward from the second side thereof and extending along the longitudinal axis thereof, the first end of the transmission member including an insert plate projecting outward from the first side of the disc for insertion into the opening of the plate, each of the two positioning rods aligning with the respective positioning hole of the lock core when mounting the lock core assembly into the receptacle and each of the two rods removably extending through the respective positioning hole; and wherein the transverse plate in the tubular member rests on a side of the second plate of the disc to prevent the transverse plate from being moved into the tubular member due to an external force, thereby preventing disengagement of the tubular member from the handle, and when the transmission member is rotated through a pre-determined angle, the transverse plate is moved into the second position within the tubular member such that the tubular member is disengaged from the handle, thereby allowing removal of the handle.

2. A lock assembly, comprising:

a tubular member;

a handle having a first end, a second end, and a longitudinal axis, the first end of the handle containing an axial hole defined therein and extending through the longitudinal axis of the handle for partially receiving and maintaining the tubular member, and the second end of the handle containing a receptacle defined therein and connecting to the axial hole;

a lock core assembly removably mounted to the receptacle of the handle and including a lock core therein, the lock core including a first end, a second end, and a longitudinal axis, the first end of the lock core containing a key hole defined therein, the second end of the lock core containing two positioning holes defined therein and extending along a direction parallel to the longitudinal axis of the lock core; and means for releasably retaining the lock core assembly in the receptacle upon rotation of the lock core assembly;

a key driving tubular member having a first end, a second end, and a longitudinal axis, the second end of the key driving tubular member including a plate mounted therein and extending in a direction transverse to the longitudinal axis of the key driving tubular member, the plate containing an opening defined therein; and a transmission member having a first end, a mediate portion, and a second end, two parallel arranged positioning rods each extending outward from the second end of the transmission member, a disc mounted on the mediate portion of the transmission member and having a first side, a second side, and a longitudinal axis, each of two positioning rods located adjacent to the second side of the disc and extending along a surface perpendicular to that of the second end of the transmission member, the disc containing a cruciform central opening therein, the first end of the transmission member including an insert plate projecting outward from the first side of the disc for removable insertion into the opening of the plate in the key driving tubular member, the insert plate and the second end of the transmission member extending through the cruciform central opening and respectively located at the first side and the second side of the disc, a stop formed on the mediate portion of the transmission member and abutting the first side of the disc, wherein each of the two positioning rods aligns with the respective positioning hole of the lock core when mounting the lock core assembly into the receptacle and each of the two rods removably extends through the respective positioning hole.

* * * * *